United States Patent [19]

Vaughn

[11] Patent Number: 5,000,326

[45] Date of Patent: Mar. 19, 1991

[54] LID CADDY

[76] Inventor: Richard C. Vaughn, 13207-B Kalmia Ct., Fairfax, Va. 22033

[21] Appl. No.: 509,800

[22] Filed: Apr. 17, 1990

[51] Int. Cl.[5] ..... A47F 7/00

[52] U.S. Cl. ..... 211/41; 211/13

[58] Field of Search ..... 211/41, 13, 87, 194, 211/2

[56] References Cited

U.S. PATENT DOCUMENTS

| | | | |
|---|---|---|---|
| 601,753 | 4/1898 | Kaiser | 211/41 |
| 839,906 | 1/1907 | Timberlake | 211/41 |
| 1,371,253 | 3/1921 | Lynch | 211/41 X |
| 1,379,379 | 5/1921 | Abrahmsen | 211/41 |
| 2,119,821 | 6/1938 | Manley | 211/41 |
| 2,620,928 | 12/1952 | Brooks | 211/41 |

FOREIGN PATENT DOCUMENTS

| | | | |
|---|---|---|---|
| 357145 | 9/1931 | United Kingdom | 211/41 |

*Primary Examiner*—Robert W. Gibson, Jr.

*Attorney, Agent, or Firm*—Sixbey, Friedman, Leedom & Ferguson

[57] ABSTRACT

The present invention provides a rack or holder for cooking container lids designed to store and hold securely a number of lids at an optimum storage angle when the rack is positioned in a vertical or in a horizontal orientation. A series of adjustable lid holding modules corresponding to the number of lids to be stored is received within a substantially rectangular support frame, which includes a removable top member to allow adjustment and insertion of the modules. Each module includes a rest element and a stop element supported by a pair of module brackets to support each lid at the desired angle. Filler modules are provided adjacent to the frame base and top.

15 Claims, 2 Drawing Sheets

LID CADDY

TECHNICAL FIELD

The present invention relates generally to racks and holders for kitchen implements and specifically to a multiposition rack for holding container lids and the like.

BACKGROUND OF THE INVENTION

Most cooks, whether amateur or professional, have accumulated a collection of covered cookware that may range from small saucepans to large soup pots and include many sizes of pots and pans in between. Even most of those householders who do not consider themselves real cooks have an assortment of covered containers in which to cook food both on top of a stove and in an oven. Restaurant and other commercial kitchens, moreover, may have very large numbers of pots, pans and other cooking containers. In both situations, the cooking containers and their respective lids must be stored when they are not in use. This problem, moreover, may be compounded by the lack of storage space in many kitchens.

Where and how these kitchen implements are stored may vary substantially from kitchen to kitchen. In some instances, pots and cooking containers are stacked in a nested fashion with the largest diameter pot on the bottom and successively smaller pots on top. While this might be a relatively efficient way to store pots, pans and other cooking vessels such as casseroles, the lids and covers usually cannot be stored effectively in a nested stack. Most kitchens, whether home or commercial, which use this storage method for pots also have a disorganized pile of lids and covers. The cook then must hunt through the pile to locate the correct lid for the container he or she wants to use. In a home kitchen this is primarily very frustrating. However, in a commercial kitchen, it can be costly since the time spent hunting for lids is time diverted from cooking.

Some cooks simply cover their pots and pans with the lids and store them side-by-side, on cabinet shelves. Although this method allows the cook to locate the correct lid quickly, it requires significantly more storage space than stacking the pots and pans. Many home kitchens simply do not have the storage space to store in this fashion the numbers of cooking containers required by large families or serious cooks. In addition, the side-by-side storage of covered containers is not usually the most effective use of storage space in a commercial kitchen.

The manufacturers of custom kitchen cabinetry for home kitchens typically include a wide range of storage options designed to organize kitchen implements. However, the storage of lids for cooking containers, as far as Applicant is aware, has not been addressed by kitchen cabinet manufacturers. Nor do the manufacturers of commercial kitchen storage equipment appear to have dealt with this problem.

Limited solutions have been attempted in the prior art. For example, U.S. Pat. Nos. 601,753 to Kaiser; 1,065,000 to Sarter et al.; 1,266,245 to Fuhrmann; and 1,528,744 to Dix all disclose holders and racks for kitchen articles, including cooking container lids. All of these racks are designed to be used only in a vertical position, preferably hung on a wall. Many kitchens, especially home kitchens, simply do not have the wall space to accommodate such a rack. Additionally, the racks disclosed by Kaiser and Fuhrmann will not hold lids of varying heights. None of the remaining racks, moreover, provides the adjustability required to store the varied collection of different sizes of cooking container lids and covers found in most home kitchens. Not only are these lids and covers likely to have different diameters, but the depth and knob height is usually different as well. As a result, a truly useful storage rack must be sufficiently adjustable to hold all of the cook's lids and covers, no matter how varied in size and shape the collection is. None of the racks disclosed by the prior art, moreover, is particularly well adapted to the storage demands of a large commercial kitchen.

The prior art, therefore, has failed to provide a storage rack or holder for cooking container lids and covers that may be positioned in one of several convenient orientations in a home or commercial kitchen and can be sized as needed to hold and store a number of lids of varying and different dimensions. Consequently, there is a need for such a rack in both home and commercial kitchens to allow storage areas to be organized effectively and efficiently to reduce clutter and provide the time savings which result when storage spaces are organized.

SUMMARY OF THE INVENTION

It is a primary object of the present invention, therefore, to provide a rack for cooking container lids that overcomes the disadvantages of the prior art.

It is a specific object of the present invention to provide a multiposition storage rack for covers and lids for cooking containers that may be easily adjusted to hold a number and variety of lids with different dimensions.

It is another object of the present invention to provide a multiposition storage rack for covers and lids for cooking containers which effectively supports the lids when it is mounted on a wall or free-standing in a vertical orientation and when it is positioned in a horizontal orientation.

It is yet another object of the present invention to provide a multiposition storage rack for cooking container covers and lids which holds the lids securely in place when the rack is oriented in any one of the multiple positions without damaging the lids.

It is a further object of the present invention to provide a multiposition storage rack for cooking container covers and lids which can be effectively adapted to hold securely either the relatively small number of lids found in a typical home kitchen or the large number of lids found in a commercial kitchen.

It is yet a further object of the present invention to provide a storage rack for cooking container lids and covers which can be adapted for use as a component of custom made kitchen cabinetry.

The foregoing objects are accomplished by providing a rack or holder for cooking container lids and covers designed to hold a predetermined number of lids and covers securely in an optimum storage orientation when the rack is in a vertical or in a horizontal orientation. The rack of the present invention includes a substantially rectangular supporting frame with opposed side members, at least one permanently attached base member and a removably attached top member. The supporting frame side members are configured to receive and store in spaced, non-interfering relationship a plurality of correspondingly configured lid holder modules including interchangeable lid rest and lid stop elements which are selected and positioned within the supporting frame according to the dimensions of the lid to be received and supported within each lid holder module. The dimensions of the supporting frame can be conveniently varied as desired and will usually be selected according to the end use and/or orientation in which the rack is to be used. The supporting frame top member may include mounting means for installing the rack on a wall or other vertical surface. The supporting frame base member is configured to support the rack filled with lids in a free-standing vertical orientation and in a horizontal orientation on a flat surface.

Other objects and advantages will be apparent from the following description, claims and drawings.

BEST MODE FOR CARRYING OUT THE INVENTION

Figure 1:
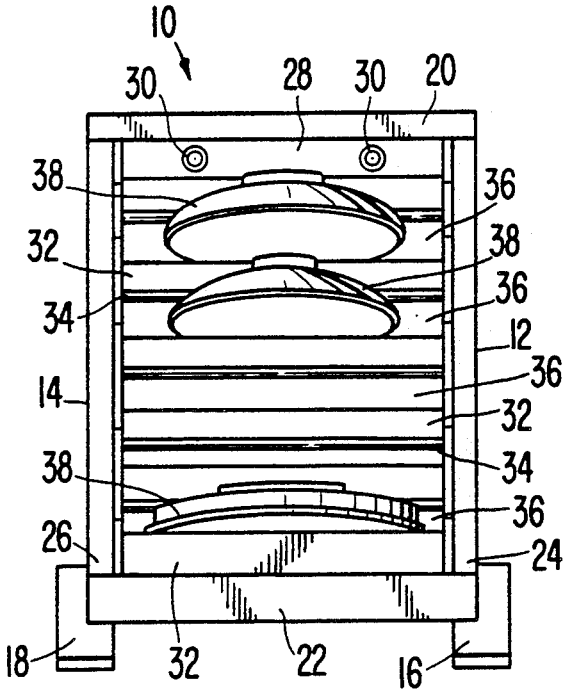
FIG. 1 illustrates a front perspective view of the lid rack of the present invention in a free-standing vertical orientation.
Figure 3:
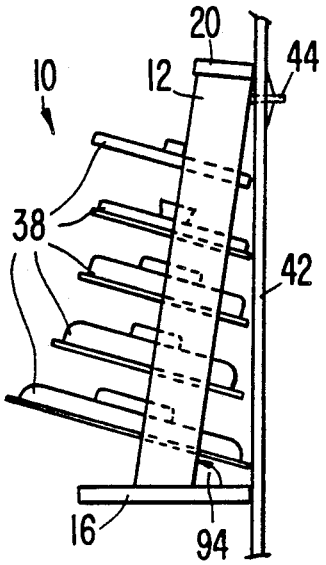
FIG. 3 illustrates a side view of the lid rack of the invention mounted on a wall in a vertical orientation.
Figure 2:
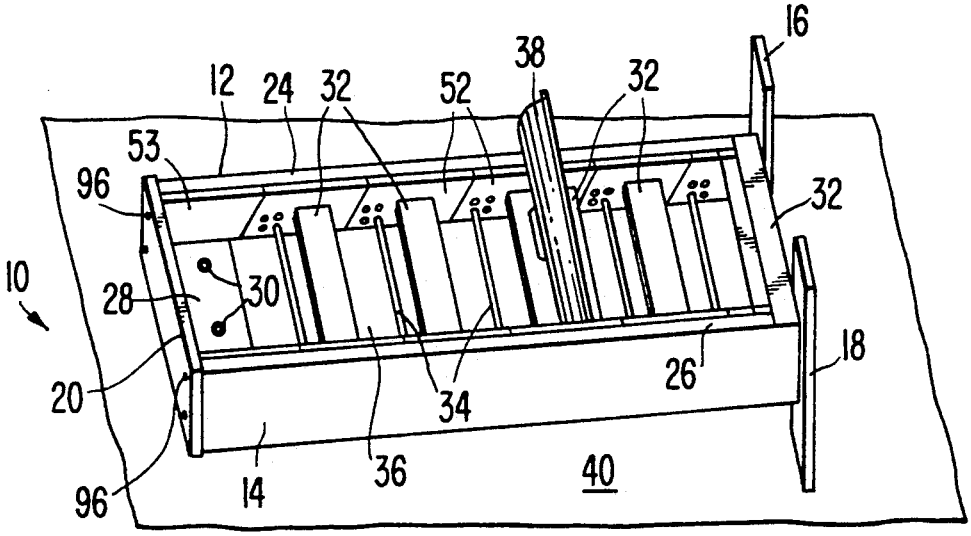
FIG. 2 illustrates a side perspective view of the lid rack of the present invention in a horizontal orientation.

The cooking container lid or cover rack of the present invention is ideally suited for both the home and the commercial kitchen. It provides a compact multi-position storage rack for lids and covers that allows easy access to the lids and covers when the rack is in either a vertical or a horizontal orientation. The unit may be constructed to hold any number of covers and lids from the relatively small number found in a typical home kitchen to the very large numbers found in a large commercial kitchen. Moreover, the capability to vary the dimensions of the lid-supporting components of the rack allows the consumer to customize the rack as needed to hold a varied assortment of lids. FIGS. 1 to 3 illustrate the primary positions and orientations in which the present rack is likely to be used.

Referring specifically to the drawings, FIG. 1 illustrates a front view of the cooking container lid rack of the present invention. The term "cooking container" is used throughout to mean containers of all kinds used for cooking food, including, but not limited to pots, pans and casserole-type baking dishes. Most of these containers are round in shape, and the lids illustrated are also round in shape. However, the rack of the present invention will support square, rectangular, elliptical and other shapes of lids as well as round lids. The rack in FIG. 1 is shown in a free-standing vertical orientation on a flat surface, such as a kitchen countertop table or the like.

The rack 10 includes a supporting frame made of multiple components. The preferred basic shape of the rack is rectangular, although a more square shape may be used, depending upon the number and sizes of lids to be accommodated. The supporting frame has a pair of side members 12 and 14, each of which is preferably permanently secured to one of a pair of base plates 16 and 18. A single continuous base plate could also be used in place of the pair of base plates shown. A top member 20 is removably attached to the side members across the ends not secured to the base plates 16 and 18. A base bar 22 is fastened to the front edges 24,26 of the side members adjacent to the base plates to provide stability to the supporting frame. A top bar 28 is fastened to the opposite, rear edges (not shown) of the side members adjacent to the top member 20 for additional stability. Mounting elements, such as the grommets 30 shown in FIG. 1, may be provided in the top bar 28 to allow the rack to be hung on suitable hooks or by other mounting elements on a wall or other vertical surface as shown in FIG. 3.

The rack 10 is designed to hold a desired number of adjustable modules which will be described in detail below in connection with FIGS. 4 and 5. Each module, which will hold one lid, includes a rest 32 and a stop 34. The rests are spaced slightly inwardly from the front surfaces 24,26 of the side members 12,14, and the stops are spaced slightly inwardly from the rear surfaces of the side members and are positioned in the modules so that the rests and stops alternate between the base and the top of the rack. Between each pair of rests and stops are spaces 36 where the lids 38 to be held and stored in the rack are inserted.

The racks shown in FIGS. 1–3 hold only a small number of lids. The length of the side members, however, can be varied within the scope of the present invention from several inches to several feet. For example, a large commercial kitchen may require storage for hundreds of container lids, while a small home kitchen may need to store only a half dozen lids or covers. The rack of the present invention is sufficiently flexible to meet the needs of both and may be constructed in virtually any size needed to produce the necessary storage. Likewise, the width of the rack 10 can be varied to accommodate lids of any width. Generally that width which will hold the largest diameter container lid to be stored will be selected. A commercial kitchen which has large numbers of lids of the same diameter may wish to use several racks, each of which is sized to hold all of the lids of one size.

Lids of different heights can be stored securely in the same unit simply by varying the widths of the rests and, thus, the spacing between the rests, as will be explained in detail below. The position of the stops is fully adjustable and can be varied as needed to support lids of different heights at an optimum storage angle. The stops are positioned to hold each lid at a substantially uniform optimum storage angle relative to the side members. This feature not only allows easy access to a selected lid without disturbing the adjacent lids, but also permits the rack 10 to be placed in one of two vertical positions and a horizontal position and still hold the lids securely so they do not fall out of the rack.

FIGS. 2 and 3 illustrate two additional orientations in which the present cooking container lid rack will efficiently and effectively hold and store lids. In FIG. 2, the rack 10 is placed on a horizontal surface 40. The base end of the rack is spaced upwardly from the horizontal surface 40 by the base plates 16 and 18. The top end of the rack, however, directly contacts the surface. This spacing of the rack from the countertop, table, or other horizontal surface permits the rack to accept larger diameter lids near the base of the rack so that these lids will not contact the surface 40. As a result, any possibility of damage to the surface 40 from the lids is eliminated.

The rack 10 in the position shown in FIG. 2 is particularly well suited for use as a custom cabinet component. The rack could be secured to a sliding shelf which would be pulled out of the cabinet to allow the cook access to the lids. Alternatively, the rack could be attached to a horizontal track or placed in a deep drawer. Other methods of adapting the rack 10 to fit inside kitchen cabinets so that it will hold cooking container lids in the spaced, angled orientations described herein are also contemplated to be within the scope of the present invention.

FIG. 3 illustrates the rack 10 mounted on a wall 42 or other substantially vertical surface, such as a cabinet, door or the like. The storage angle of the lids 38 can be clearly seen in FIG. 3. The base plates, of which only base plate 16 is shown in FIG. 3, space the base end of the rack away from the wall so that larger lids can be received in the base part of the rack. The top member 20 contacts the wall 42 as shown. Suitable fasteners, such as the toggle bolt 44, have been inserted through the grommets 30 (FIGS. 1 and 2) to mount the rack on the wall. If it is desired to remove the rack from the wall more easily, wall mounted hooks may be used instead of toggle bolts or more permanent mounting elements.

The angle at which the lids are held keeps them in place in the rack and prevents them from falling out, particularly when the rack is in the vertical orientation of FIGS. 1 and 3. In addition, this optimum storage angle facilitates both the insertion of the lids into the rack and the removal of the lids from the rack without interfering with the other stored lids. The selection of the optimum angle and the maintenance of the lids at this angle by the rack components will be discussed in detail below in connection with FIG. 5.

Figure 4:
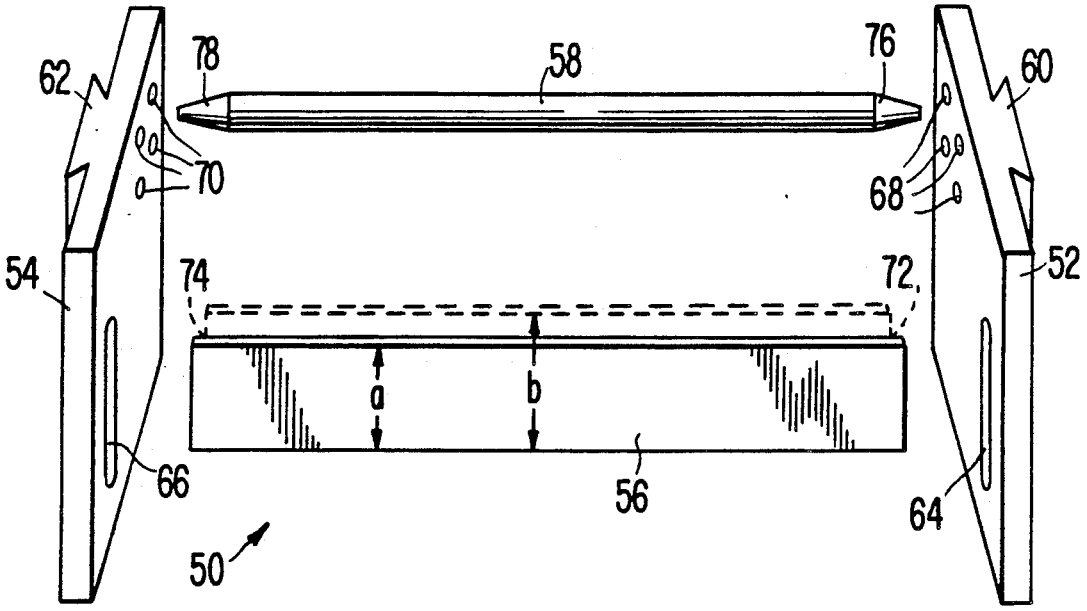
FIG. 4 illustrates, in exploded front perspective of a standard lid holder module according to the present invention.

FIG. 4 illustrates the components of a lid holding module 50 of the present rack. The rack 10 could be constructed so that the rests 32 and stops 34 are permanently attached to the supporting frame side members 12 and 14 and are, therefore, not removable. A cooking container lid rack constructed in this manner is contemplated to be within the scope of the present invention. The preferred construction of the rack, however, employs a number of removable lid holding modules. The specific number of modules selected will be determined by the number of lids to be stored in the rack. Because a single standard size module can be provided to accommodate almost all available lid sizes, the rack of the present invention can be manufactured quite economically.

Each lid holding module 50 has four components: a right bracket 52, a left bracket 54, a rest 56 and a stop 58. The right bracket 52 and the left bracket 54 are mirror images of each other. Each bracket 52,54 is formed with a central dovetail 60,62 as shown in FIG. 4 that extends along the entire height of the bracket. Any similar longitudinal projecting ridge or tongue could be substituted for the dovetail shape shown. However, the dovetail is preferred because it can be seated very securely in a correspondingly configured dove track 80 (FIG. 5) in each side member. Each bracket also includes a rest channel 64,66 and a plurality of stop recesses 68,70.

The width of the rest 56 can be varied as needed, and it is contemplated that rests of different widths would be supplied with each set of modules so that a suitable width rest for holding each lid will be available. The larger the width of the rest is, the smaller the space between the rests will be. Therefore, if lids with small heights (knob or handle-to-edge dimension) are to be stored, wide rests should be selected to produce the narrow spaces that will hold these lids most effectively. However, if lids with larger heights are to be stored, the use of a smaller width rest will produce a larger space between rests. Two different rest widths are shown in FIG. 4. To reduce manufacturing costs and for ease of manufacture, the rest channels 64,66 in each module bracket 52,54 are made a single standard size. A standard size rest 56 would have a width a, which corresponds approximately to the length of channels 64 and 66. However, if a rest of width b is required, the rest 56 is made wider only along that portion of the rest that will extend between the module brackets when the rack is assembled. Integral tabs 72 and 74 will be formed at each end of the rest to fit into the module rest channels 64 and 66. The width of the rest 56 can also be made smaller than width a, larger than width b, or any width in between as long as tabs or projections are provided at each end and are sized to engage the rest in the module rest channels securely.

The stop 58 is preferably formed from a dowel with champfered ends 76,78 which are inserted into one of the correspondingly configured rest recesses 70. The particular recess 70 selected will depend upon the height of the lid to be stored by the module. Four rest recesses are shown in the drawings. While this number provides optimum adjustability of the stops, more or fewer recesses could also be used.

Figure 5:
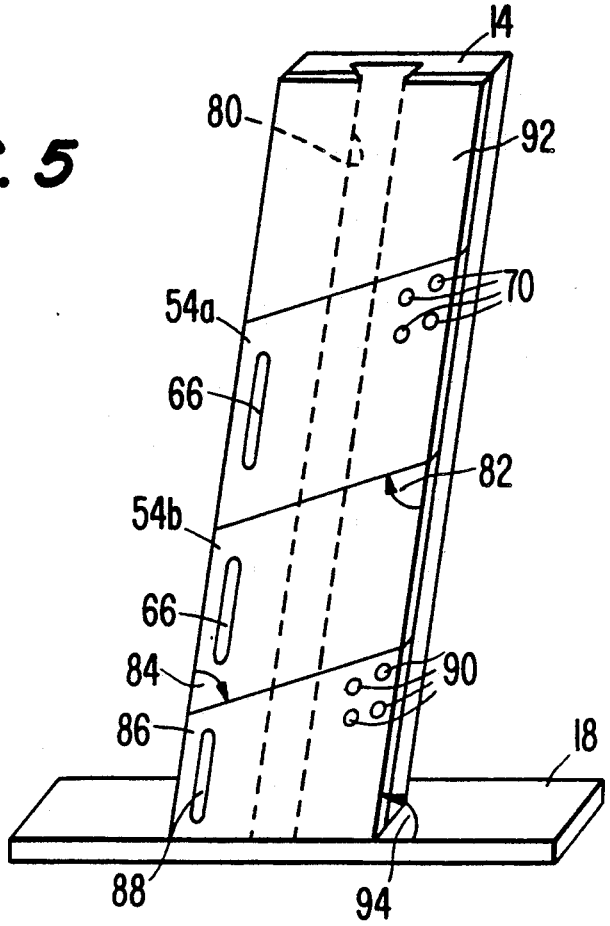
FIG. 5 illustrates a side perspective view of the right lid holder module-receiving supporting frame side member showing a number of modules in place in the side member.

FIG. 5 illustrates the inside of the right side member 14 with several modules in place. The preferred orientation of the side member relative to the base plate 18 is also clearly shown in FIG. 5, as are the optimum angles for construction of the module brackets. Two standard module brackets **54*a* and 54*b* are shown engaged by the dove track 80 in side member 14. It has been determined that forming the module brackets in the configuration of a parallelogram facilitates assembly of the lid holding rack so that the lids will be received and held at an optimum storage angle. Additionally, the relative locations of the rests and stops on adjacent modules can be optimally established with a module bracket of this configuration. Angles 82 and 84** of the parallelogram should be approximately 30° to produce the desired results. The specific locations of the stop recesses, moreover, are selected so that the lid is held at an optimum storage angle, no matter which recess the stop is located in.

The angled parallelogram configuration of the module brackets **54*a* and 54*b* does not allow them to fit securely in place adjacent to either the base plate 18 or the top member (not shown in FIG. 5). Consequently, specially configured base and top filler modules are provided to hold the module brackets in place. A base filler module 86, which may optionally include a rest channel 88 and stop recesses 90 is configured to fit between the base plate 18 and the last module bracket, here bracket 54*b*. A top filler module 92, which will not usually include either a rest channel or stop recesses, is configured to fit between the first module bracket, here bracket 54*a*, and the top member. FIG. 2 also illustrates a number of left module brackets 52 and a top filler module 53 received in the dove track (not shown) in the side member 12**.

Maintaining the stored lids at an optimum angle is insured not only by the angled module brackets and relative positions of the rests and stops, but also by the orientation of the side members 12 and 14 relative to the base plates 16 and 18. This can best be seen in FIGS. 3 and 5. To provide optimum support to a number of lids, particularly in the vertical orientation shown in FIGS. 1 and 3, and to maintain the stored lids at an angle that will keep them in place, yet allow their easy insertion and removal, the angle 94 between the side members 12,14 and the base plates 16,18 should be within the range of about 5° to 9°.

Once the number of lids to be stored has been determined and the desired overall dimensions of the rack have been selected accordingly, a standard lid holding module for each lid is obtained. Side members of the correct size are permanently secured to a pair of base plates 16,18 or a single base plate (not shown) as desired. A base bar 22 and a top mounting bar 28 may also be attached to the side members at this time. The correct number of lid holding modules 50 is inserted between the side members so that the module dovetails are received in the dove track in each side member, between a base filler module such as module 86 in FIG. 5 and a top filler module, such as module 53 in FIG. 2 and module 92 in FIG. 5. The top member 20 is then positioned in place at the free ends of the side members and removably secured to the side members by screws 96 (FIG. 2). The top member may be removed as needed to permit the adjustment of the module brackets, rests and stops.

The lid rack of the present invention may be constructed of a variety of different materials. All of the components may be made of wood, such as oak or pine or the like, that can be stained or painted as desired to provide a decorative touch to a kitchen. If the rack is intended for use as a custom cabinet component, it will also most likely be made of wood. Some of the components or the entire rack could also be formed of a suitable durable plastic. It is also contemplated to be within the scope of the present invention to form the module components of plastic and the supporting frame components of wood, metal or another suitable material. Additionally, the module components could be formed of metal as well. The choice of materials will depend, to a large extent, on the end use of the rack of the present invention. More decorative materials are likely to be preferred in home kitchens, while materials that are easily cleaned and sanitized will be preferred in commercial kitchens.

The present invention has been described herein with respect to a preferred embodiment. However, modifications and variations of these embodiments which perform the same function are also contemplated to be within the scope of the present invention.

INDUSTRIAL APPLICABILITY

The present invention will find its primary application in enhancing the storage capabilities and organization and reducing clutter in home and commercial kitchens. Its multiposition versatility is not limited to kitchen use, however. The cooking container lid rack described herein can also be effectively used as a store display rack to display cookware lids or covers. Although its primary utility is directed to the storage and display of lids, the present rack is also well suited to hold and display any similarly shaped substantially planar article.

I claim:

1. A rack positionable in a substantially vertical orientation and in a substantially horizontal orientation for storing and securely holding within said rack at an optimum storage angle when said rack is positioned in either said substantially vertical orientation or said substantially horizontal orientation a plurality of cooking container lids, said rack including:

(a) support frame means for positioning said rack alternatively in said substantially vertical orientation or in said substantially horizontal orientation(s); and (b) a plurality of adjustable lid holding module means removably fitted into said support frame means for receiving said plurality of lids, wherein each of said module means is adjustable to support each of said lids substantially within said support frame means at said optimum storage angle in spaced, non-interfering parallel relationship with adjacent lids when said rack is in said substantially vertical and in said substantially horizontal orientation.

2. A rack as described in claim 1, wherein said support frame means has a substantially rectangular shape and includes a pair of spaced longitudinal side members, at least one base plate permanently secured to one end of each of said side members and a top member removably attached to the opposite end of each of said side member.

3. A rack as described in claim 2, wherein each of said pair of side members is secured to said base plate so that each said side member forms an angle of within the range of about 5° to 9° with said base plate.

4. A rack as described in claim 1, wherein each said lid holding module means includes bracket means for adjustably supporting a rest element and a stop element within said support frame means.

5. A rack as described in claim 4, wherein said bracket means includes a pair of module brackets each having the configuration of a parallelogram and each of said module brackets includes rest channel means for receiving and supporting said rest element and stop recess means for adjustably positioning said stop element.

6. A rack as described in claim 5, wherein said module brackets are mirror images of each other and include at least one angle of about 30°.

7. A rack as described in claim 2, wherein each said side member includes a central longitudinal groove and each said module means includes bracket means for adjustably supporting a rest element and a stop element and said bracket means includes tongue means for sliding insertion into said groove.

8. A rack as described in claim 7, wherein said tongue means has the configuration of a dovetail and said groove has the configuration of a dove track.

9. A rack as described in claim 8, wherein said module means are positioned along the entire longitudinal extent of said side members so that the tongue means of each of said bracket means is received in said groove and said rest elements are substantially parallel to each other and said stop elements are substantially parallel to each other and said rest elements and stop elements are substantially perpendicular to said side members.

10. A rack as described in claim 9, wherein said rest element is positioned relative to said stop element so that a lid inserted between adjacent rest elements is held at said optimum storage angle.

11. A rack as described in claim 10, wherein said bracket means includes rest channel means for receiving and supporting said rest elements and stop recess means for adjustably positioning said stop element so that said stop element may be adjustably positioned to hold said lid at said optimum storage angle.

12. A rack for storing and holding at a desired angle a plurality of cooking container lids in spaced, non-interfering relationship, said rack including:

(a) a substantially rectangular supporting frame with side members, a permanently attached base plate and a removably attached top member;

(b) a plurality of removable lid supporting modules corresponding in number to the number of lids to be stored in the rack slidingly mounted within said side members to extend substantially perpendicularly therebetween; and (c) at least two filler modules, one of said filler modules being positioned between the base plate and a lid holding module and the other of said filler modules being positioned between the top member and a lid holding module.

13. A rack as described in claim 12, further including mounting means for mounting said rack in a vertical orientation on a vertical surface so that the base plate does not contact a horizontal support surface.

14. A rack as described in claim 13, wherein said base plate is attached to said side members at an angle in the range of from about 5° to 9° and said base plate is configured to support the rack both in a free-standing vertical orientation on a horizontal surface and in a horizontal orientation.

15. A rack as described in claim 14, wherein each of said lid holding modules includes a pair of mirror image parallelogram shaped brackets and each of said brackets includes a rest channel for removably receiving a rest element and a plurality of stop recesses for removably receiving a stop element.

* * * * *